US005265649A

United States Patent [19]

Iwano et al.

[11] Patent Number: 5,265,649

[45] Date of Patent: Nov. 30, 1993

[54] CLOTH ROLL EXCHANGE APPARATUS FOR A LOOM

[75] Inventors: Yoshimi Iwano; Yoichi Makino; Tetsuya Furuta, all of Kariya, Japan

[73] Assignee: Kabushiki Kaisha Toyoda Jidoshokki Seisakusho, Kariya, Japan

[21] Appl. No.: 907,188

[22] Filed: Jul. 1, 1992

[30] Foreign Application Priority Data

| | | | |
|---|---|---|---|
| Jul. 10, 1991 | [JP] | Japan | 3-170029 |
| Nov. 28, 1991 | [JP] | Japan | 3-314854 |
| Nov. 29, 1991 | [JP] | Japan | 3-316955 |

[51] Int. Cl.[5] ..... D03D 49/00

[52] U.S. Cl. ..... 139/1 R; 139/291 C; 242/58.3

[58] Field of Search ..... 242/58.3, 56 R, 66; 139/1 R, 291 C

[56] References Cited

U.S. PATENT DOCUMENTS

| | | | |
|---|---|---|---|
| 4,606,381 | 8/1986 | Suwa et al. . | |
| 4,892,119 | 1/1990 | Hugo et al. | 242/58.3 X |
| 5,031,666 | 7/1991 | Raaijmakers et al. | 139/1 R |
| 5,042,533 | 3/1991 | Kuwahara et al. . | |
| 5,063,970 | 11/1991 | Tanaka et al. | 139/1 R |
| 5,092,368 | 3/1992 | Tanaka et al. | 139/1 R |

FOREIGN PATENT DOCUMENTS

| | | |
|---|---|---|
| 100064A4 | 3/1989 | Belgium . |
| 0296113 | 12/1988 | European Pat. Off. . |
| 0296115 | 12/1988 | European Pat. Off. . |
| 0405551 | 1/1991 | European Pat. Off. . |
| 0438972 | 7/1991 | European Pat. Off. . |
| 60-171956 | 5/1985 | Japan . |
| 60-177143 | 11/1985 | Japan . |
| 61-23060 | 1/1986 | Japan . |
| 1-97241 | 4/1989 | Japan . |
| 1-285549 | 11/1989 | Japan . |
| 2-52839 | 2/1990 | Japan . |

*Primary Examiner*—Andrew M. Falik

*Attorney, Agent, or Firm*—Brooks Haidt Haffner & Delahunty

[57] ABSTRACT

A full roll transferred from a cloth wind-up position in a weaving machine to a temporary full-roll storage position on a transfer carriage is prevented from rotation by meshing with a gear mounted stationarily. The transfer carriage is equipped with empty roll supporting arms and cutter supporting arms having free ends at which a cloth cutting mechanism is supported. An empty roll is supported by a holding device mounted at free ends of the empty roll supporting arms so as to be rotated by an empty roll driving motor. Owing to rotation of the empty roll, tension is applied to a cloth between the full roll and the empty roll so that it is cut by the cloth cutting mechanism in a tensioned stationary state.

17 Claims, 9 Drawing Sheets

CLOTH ROLL EXCHANGE APPARATUS FOR A LOOM

BACKGROUND OF THE INVENTION

1. Field of the Invention

The present invention relates to a method and an apparatus for automatically exchanging a full cloth roll (i.e. a roll of woven fabric or cloth fully wound) with an empty cloth roll (i.e. a roll having no cloth wound thereon) in a weaving machine installation. The present invention also relates to detection of woven fabric or cloth (hereinafter referred to as the cloth), detection of a tension imparted to the cloth extending between the full cloth roll and the empty cloth roll, and cutting thereof in the cloth roll exchange apparatus.

2. Description of the Prior Art

The automatic cloth roll exchange apparatuses of the type mentioned above are disclosed in Japanese Unexamined Patent Application Publication No. 17956/1985 (JP-A-60-17956), Unexamined Utility Model Application Publication No. 177143/1985 (JU-A-60-177143), Unexamined Patent Application Publication No. 23060/1986 (JP-A-61-23060) and Unexamined Patent Application Publication No. 97241/1989 (JP-A-H1-97241).

The automatic cloth roll exchange apparatus disclosed in JP-A-60-17956 and JU-A-60-177143 is installed on a cloth roll transporting carriage or bogie which is called upon completion of cloth winding on a cloth roll in a weaving machine or loom to move to a cloth roll transfer position located in front of the loom. Upon arrival of the transporting carriage at the cloth roll transfer position, the automatic cloth roll exchange apparatus installed on the carriage performs a series of cloth roll exchange operations, whereby the cloth roll fully wound (hereinafter referred to as the full cloth roll or simply as the full roll) is transferred onto the transporting carriage while an empty cloth roll (hereinafter also referred to simply as the empty roll) carried on the transporting carriage is shifted to the loom. Subsequently, a cloth cutting mechanism constituting a part of the automatic cloth roll exchange apparatus cuts the cloth extending between the empty roll and the full roll. A leading end portion of the cloth as cut is wound around the empty roll, while a trailing end portion of the cloth is wound up around the full roll. The empty roll transferred to the cloth wind-up position in the loom is operatively coupled to a loom driving motor. In that case, the winding of the leading end portion of the cloth onto the empty roll is realized by making use of air jets. The empty roll onto which the leading end portion of cloth has been wound starts to take up the cloth. Thus, the cloth roll exchange can be carried out without need for stopping operation of the loom.

On the other hand, in the case of the exchange apparatuses disclosed in JP-A-60-17956 and JU-A-60-177143, the full roll transferred to the cloth roll transporting carriage is imparted with a tension by rotating the full roll, and the cloth cutting is performed in the tensioned state of the cloth. The weaving operation is continued even during the cloth roll exchange operation. As a consequence, the cloth is cut obliquely, whereby a number of wefts are cut as well, resulting in that the cutting property of the cutter undergoes degradation within a short time. Also, the oblique cutting is likely to involve irregular cut because of significant sliding or frictional resistance exerted to a side surface of the cutting blade.

In the exchange apparatuses disclosed in JP-A-60-17956, JU-A-60-177143 and JP-A-61-23060, a single cloth roll transporting carriage is designed to serve a plurality of weaving machines or looms. Consequently, there may arise such situation that a lot of time is taken for the cloth roll carriage to arrive at the loom requesting the cloth roll exchange. In that case, the length of the woven fabric or cloth will exceed considerably the predetermined length. To avoid such undesirable situation, the loom operation must necessarily be stopped, which apparently results in poor operation efficiency or availability of the loom.

In the prior art apparatus disclosed in JP-A-H1-97241, a full cloth roll disposed at the cloth wind-up position and supported by a pair of driving rollers is pushed outwardly by a push-out lever and rolls out onto a cloth receiving lever which is thereby caused to swing downwardly against a force of a tension spring from the upstanding state. Subsequently, an empty roll is dropped into the cloth wind-up position, where upon the cloth spanning the empty roll and the full roll is cut by a cutter moved in the direction widthwise of the cloth. In this way, the weaving operation can be performed by temporarily placing the full roll on the receiving lever.

However, in the case of the exchange apparatus disclosed in JP-A-H1-97241, the loom operation is temporarily stopped during the cloth roll exchange process. Otherwise, the driving rollers supporting the full cloth roll will feed the cloth pressed against the driving rollers under the gravity of the empty roll placed thereon to the full cloth roll disposed at the temporary storage position on the cloth receiving lever, which results in that the cloth existing between the empty roll and the full roll is slackened, making it impossible to cut the cloth. For this reason, temporary stoppage of the loom operation is unavoidable.

Furthermore, in the automatic cloth roll exchange apparatus disclosed in JP-A-H1-97241, detection of presence of the cloth rolls at the supporting positions, i.e. the cloth wind-up position and the temporary storage position, is indispensably required in order to automatically execute a sequence of operations involved in the cloth roll exchange, i.e., discharge of the full cloth roll from the cloth wind-up position to the temporary storage position, disposition of the empty roll at the cloth wind-up position, and cutting of the cloth extending from the full cloth roll located at the temporary storage position. Also, there are required not only detection of the leading end portion of the cloth wound around the empty roll disposed at the cloth winding position, but also detection of the tension of the cloth in order to ensure a satisfactory cutting thereof.

In this conjunction, there is disclosed in JP-A-H2-52839 a cloth take-up detecting device which includes a disk plate fixedly mounted on a driving shaft operatively coupled to a shaft of the empty roll and a proximity switch adapted to detect a groove/projection repetition row circularly arrayed on the disk plate. The proximity switch generates a pulse signal having a frequency which corresponds to the rotational speed of the disk plate, wherein completion of the operation for winding the leading end portion of the cloth onto the empty roll is determined by detecting a decrease in the frequency of the signal generated by the proximity switch. Rotation of the empty roll for taking up the leading end portion of the cloth is performed by deriving a driving power from a loom driving motor through a transmission system in which a torque limiter is incorporated for maintaining constant the tension applied to the cloth being wound up during the weaving operation. In this conjunction, it is noted that the empty roll having no cloth wound thereon will rotate at a higher speed as compared with the rotational speed thereof during the normal weaving operation. Accordingly, upon completion of operation for winding the leading end portion of the cloth around the empty roll, tension of the cloth will increase up to a predetermined value. Thus, detection of completed operation of winding the leading end portion onto the empty roll can be realized by detecting change in the tension of the cloth.

However, because the disk plate is not mounted on the shaft of the empty roll, there is required an additional detector for detecting presence or absence of the empty roll at the cloth wind-up position. An increase in the number of detectors means a limitation imposed on the design choice of the complicated mechanism of the cloth roll exchange apparatus.

Furthermore, it should be added that JP-A-H1-28554 discloses a cloth roll transfer apparatus in which a temporary full roll storage position is provided on a transfer carriage which can moved between a stand-by position closely located to the cloth wind-up position and a transfer position for transferring the full roll to a cloth roll transporting carriage. However, this prior art cloth roll exchange apparatus includes no mechanism for placing the empty roll at the cloth wind-up position and therefore relies on manual operation for exchanging the full roll with the empty roll.

SUMMARY OF THE INVENTION

Accordingly, a principal object of the present invention is to provide an apparatus which is capable of automatically carrying out the cloth roll exchange operation without necessity of stopping loom operation.

Another object of the present invention is to provide a method and an apparatus capable of satisfactorily performing cloth cutting operation in the course of the cloth roll exchanging operation without need for stopping the weaving operation.

Yet another object of the present invention is to provide a cloth roll exchange apparatus which is capable of detecting presence or absence of a cloth roll at a cloth wind-up position and/or a temporary roll storage position by using a single detector.

With the above and other objects in view, according to an aspect of the present invention, a cloth roll exchange apparatus for a weaving machine is provided, which comprises a transfer carriage adapted to be selectively disposed at a storage position and a cloth roll transfer position, temporary full roll hold means and temporary empty roll hold means both installed on the transfer carriage, an empty roll inserting mechanism installed on the transfer carriage for moving and inserting an empty roll including a cloth roll shaft from the temporary empty roll hold means to the cloth wind-up position, and cloth cutting means installed on the transfer carriage for cutting a cloth consecutively extending from the full cloth roll disposed at the temporary full roll hold means to the weaving machine.

The transfer carriage is normally located at the storage or retracted position. Upon completion of the cloth wind-up operation for a cloth roll disposed at the cloth wind-up position, the full cloth roll is discharged into a temporary full roll storage or hold position on the transfer carriage by means of a full roll discharge mechanism. The transfer carriage having the full cloth roll loaded thereon moves to a full roll transfer position where the full roll is exchanged with an empty roll, which is then disposed at the temporary full roll storage or hold position. Subsequently, the empty roll is moved to the cloth wind-up position by the empty roll inserting mechanism. A web of the cloth extending from the temporary full roll storage position continues to the cloth being woven by the loom and is cut by the cloth cutting mechanism installed on the transfer carriage.

According to another aspect of the invention, it is proposed that the full roll is moved from the cloth wind up position to a temporary full roll storage or hold position, whereon a path of cloth existing between the full roll disposed at the temporary full roll storage position and an empty roll which is not yet disposed at the cloth wind-up position on a cutting path of a cutter adapted to move in a direction widthwise of the cloth, and the cloth is cut along the cutting path in the state in which the cloth is held stationarily and maintained under tension.

In order to carry out the cloth cutting as mentioned above, the cloth cutting means comprises means for preventing rotation of the full roll transferred to the temporary full roll hold means from the cloth wind-up position, means for holding the empty roll so that the empty roll is brought into contact with the cloth continuously extending from the full roll disposed at the temporary full roll hold means to the weaving machine, means for rotating the empty roll held by the empty roll holding means, and means for cutting the cloth existing between the full roll disposed at the temporary full roll hold means and the empty roll brought into contact with the cloth along a cutting path extending in the direction widthwise of the cloth.

The full roll disposed at the temporary full roll storage or hold position is prevented from rotation by the rotation preventing means, while the empty roll is held by the empty roll holding means so that the empty roll is brought into contact with a web of the cloth which continuously extends from the full cloth roll to the loom. In the state where the empty roll is prevented from rotation and held in contact with the cloth, the full roll is rotated by the full roll driving means, whereby a web of the cloth spanning the full roll and the empty roll is placed under tension. Because the empty roll is prevented from rotation, there takes place no displacement of the cloth between the full roll and the empty roll. Thus, the cloth is cut in the stationary state under a tension by the cutting means. In other words, the oblique cutting of the cloth can positively be avoided. To state in another way, the cloth cutting operation can be performed without moving the cloth relative to the cutting path, whereby the cloth cutting operation can be performed in a satisfactory manner without need for stopping the weaving operation while avoiding the oblique cutting of the cloth.

In the cloth roll exchange apparatus according to a further aspect of the present invention, it is proposed that a row of alternating grooves and projections is circumferentially provided on a cloth roll shaft, a proximity switch is disposed in the vicinity of the cloth roll supporting position, the groove/projection repetition row defining an area to be detected by the proximity switch, and that cloth roll driving means for rotating the cloth roll is disposed at the cloth roll supporting position.

In the above arrangement, when the full cloth roll is moved from the cloth wind-up position to the temporary storage position, the proximity switch disposed in the vicinity of the temporary full-roll storage or hold position responds to the groove/projection repetition row provided on the full cloth roll to thereby detect the presence of the full cloth roll. In succession to the removal of the full cloth roll, the empty roll is disposed at the cloth wind-up position. The proximity switch mounted in the vicinity of the cloth wind-up position then detects the groove/projection repetition row provided on the empty roll to thereby confirm the presence of the empty roll. By rotating the full cloth roll at the temporary storage position in the cloth wind-up direction by the cloth roll rotating means, a tension is applied to a web of the cloth extending from the full cloth roll, as a result of which the frequency of the signal generated by the proximity switch device installed in the vicinity of the temporary full-roll storage position decreases, to allow the tensioned state of the cloth to be detected. By rotating the empty roll at the cloth wind-up position by the cloth roll rotating means, a corresponding tension is applied to the cloth being taken up by the empty roll, whereby the frequency of the pulse signal generated by the proximity switch device decreases correspondingly. Thus, the tensioned state of the cloth can be determined on the basis of the frequency of the signal generated by the proximity switch device. In this manner, completion of winding the leading cloth end portion around the empty roll can be detected.

By virtue of such arrangement that the groove/projection repetition row provided on the shaft of the cloth roll constitutes the area to be detected by the proximity switch while allowing the cloth roll at the cloth roll supporting position (i.e., the cloth wind-up position or temporary full roll storage position) to be rotated, it is possible to detect both the presence or absence of the cloth roll at the cloth roll supporting position and the tension applied to the cloth by using only one proximity switch. Thus, the number of the detectors can be decreased, whereby the limitation imposed as to the design of the cloth roll exchange apparatus can be mitigated.

These and other features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

In the course of the following detailed description, reference will be made to the attached drawings, in which.

DESCRIPTION OF THE PREFERRED EMBODIMENTS

Figure 1:
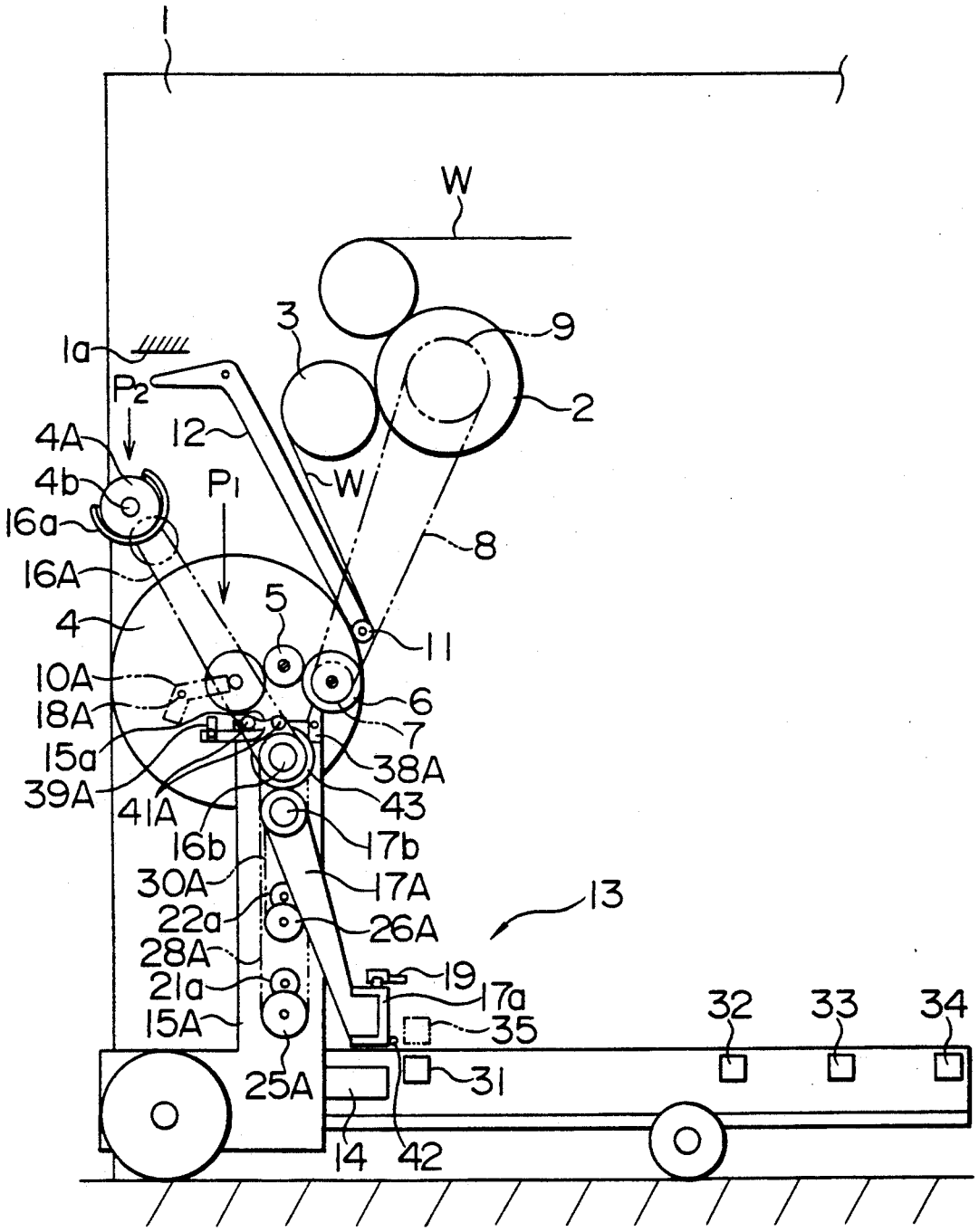
FIG. 1 is a side elevational view showing a cloth roll exchange apparatus according to a first embodiment of the present invention in the state in which a transfer wagon is at a stored or retracted position.

Now, the present invention will be described in detail in conjunction with preferred embodiments thereof by reference to the accompanying drawings, in which like reference numerals denote like or equivalent parts throughout several views.

Referring to FIG. 1 to 6, there is shown a first embodiment of the present invention. In FIG. 1, a reference numeral 1 denotes side frames which are disposed in opposition to each other at both sides of a weaving machine or loom (only one of the side frames is shown in FIG. 1). Rotatably mounted between the side frames 1 are a surface roller 2 and a press roller 3 which cooperate together to draw out a cloth W. The cloth W as drawn out is then wound up by a cloth roll 4 which is disposed at a cloth wind-up position $P_1$. A cloth guide bar 11 is mounted so as to be brought into contact with a peripheral cloth surface of the cloth roll 4 and serves to prevent formation of creases in the cloth as it is wound onto the cloth roll 4. The cloth guide bar 11 is supported by a pair of supporting arms 12 disposed in opposition to each other, wherein rotation or angular position of the supporting arm 12 is limited by a stopper member 1*a* secured fixedly on the side frame 1. More specifically, the lowermost position to which the cloth guide bar 11 can be moved is restricted to a position shown in FIG. 3 by limiting the rotation or swing of the paired supporting arms 12 by means of the stationary stopper member 1*a*.

Figure 2:
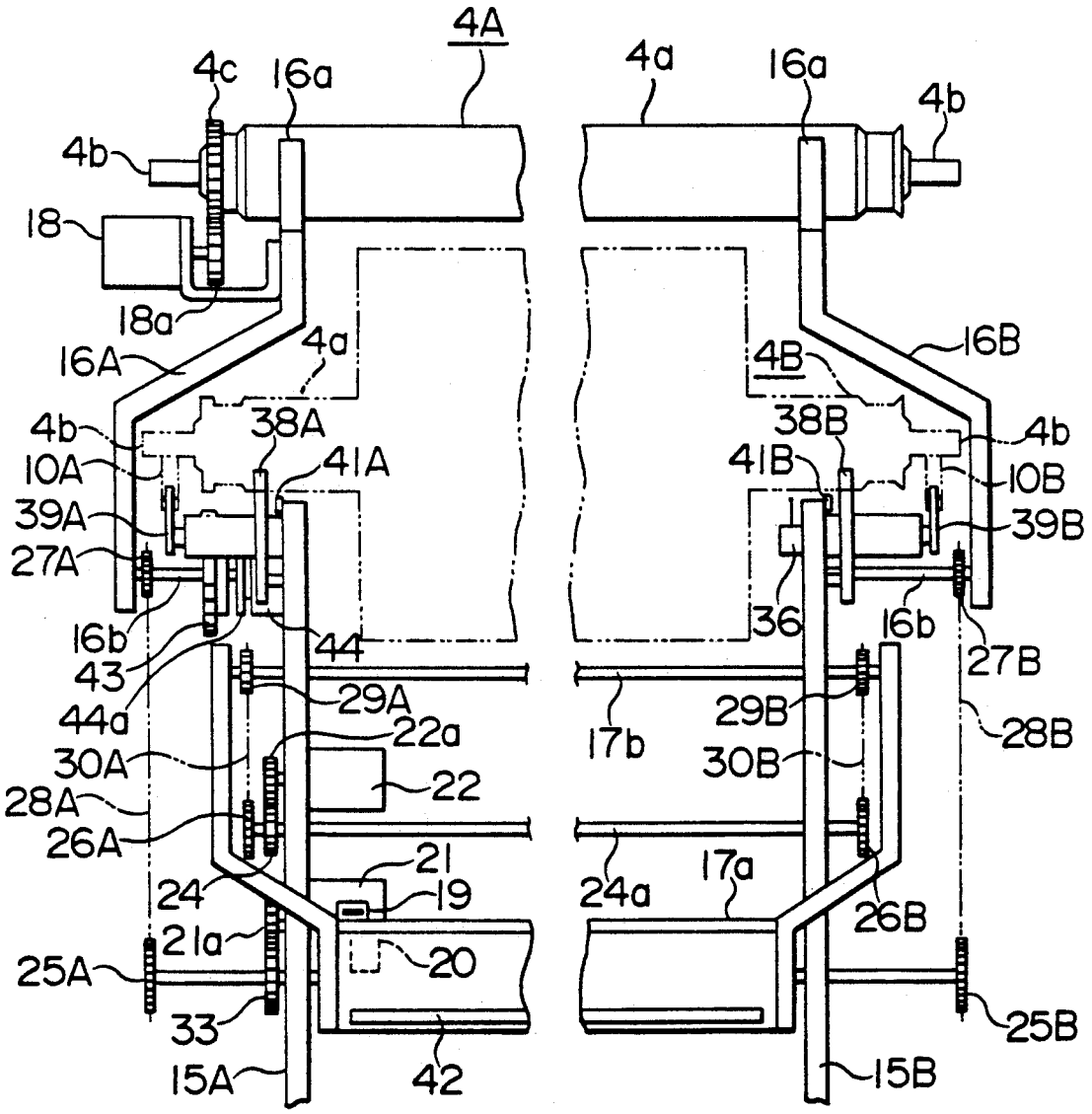
FIG. 2 is a rear side view showing a major portion of the transfer wagon shown in FIG. 1 with some parts being omitted from illustration.

Referring to FIG. 2, it will be seen that a roll shaft of the cloth roll 4 has an enlarged, large diameter shaft portion 4*a* and reduced, small diameter shaft portions 4*b*, wherein the reduced shaft portions 4*b* of the cloth roll 4 are rotatably received in respective bearing recesses (not shown in FIG. 2) so that the cloth roll 4 is disposed at the cloth wind-up position $P_1$. A series of teeth or a toothed wheel 4*c* is formed in the enlarged shaft portion 4*a* at one end thereof. The toothed wheel 4*c* is adapted to mesh with a driving gear 5 when the cloth roll 4 is disposed at the cloth wind-up position $P_1$. The driving gear 5 in turn is operatively coupled to the surface roller 2 by way of an intermediate gear 6, a sprocket 7, a chain 8 and another sprocket 9. Thus, the cloth roll 4 can be rotated in the cloth wind-up direction in synchronism with the rotation of the surface roller 2 which is driven by a loom driving electric motor (not shown).

Referring to FIGS. 1 and 2, the cloth roll 4 disposed at the cloth wind-up position $P_1$ is normally prevented from rolling out from the above bearing recesses by means of cloth roll stoppers 10A and 10B which bear against the respective reduced shaft portions 4*b* of the cloth roll 4 and which are held at the cloth roll restraining position (i.e., the position for preventing the cloth roll from rolling out) by means of respective return springs (not shown).

As shown in FIG. 1, a transfer wagon generally denoted by a reference numeral 13 is disposed at a storage position between the side frames 1. The transfer wagon 13 is caused to run forwardly or backwardly in the longitudinal direction of the loom by rotating a reversible motor 14 in a forward or backward direction. The transfer wagon 13 is provided with a pair of upstanding struts 15A and 15B disposed in opposition to each other, wherein a temporary full-roll supporting recess 15*a* is formed in each of the top ends of the upstanding struts 15A and 15B. A pair of rollers 41A and 41B are mounted in the vicinity of each temporary full-roll supporting recess 15*a* in such disposition that the associated enlarged shaft portion 4*a* of the cloth roll 4 can be rested on the pair of rollers 41A and 41B.

A limit switch 36 is mounted on one of the upstanding struts (the upstanding strut 15B in the case of the illustrated embodiment) at a position close to the top end thereof so that the limit switch 36 is closed by the enlarged shaft portion 4*a* of the cloth roll 4 when it is disposed on the paired rollers 41A and 41B.

As can be seen in FIGS. 1 and 2, at the top ends of the upstanding struts 15A and 15B, there are mounted a pair of kick-out levers 38A and 38B and a pair of roll-out restraint release levers 39A and 39B, respectively.

Additionally, a pair of empty roll supporting arms 16A and 16B as well as a pair of cutter supporting arms 17A and 17B are rotatably or swingably mounted on the upstanding struts 15A and 15B, wherein a hand 16*a* serving as holding means is mounted at each of the free ends of the paired empty roll supporting arms 16A and 16B. The hand 16*a* is made of a leaf spring having an arcuate cross section for releasably gripping the enlarged shaft portion 4*a* of an empty roll 4A.

One of the empty roll supporting arms (arm 16A in the case of the illustrated embodiment) is equipped with an empty roll driving motor 18 which may comprise a conventional torque motor. A driving gear 18*a* mounted on the output shaft of the empty roll driving motor 18 meshes with the toothed wheel 4*c* of the empty roll 4A supported by the hands 16*a* so that the empty roll 4A held by the hands 16*a* can be rotated in either of the forward or backward direction as the empty roll driving motor 18 is rotated in the forward or reverse direction.

Supported between the pair of cutter supporting arms 17A and 17B at the free ends thereof is a bar 17*a* on which a cutter 19 is mounted so as to be capable of moving to the left or right along the longitudinal axis of the bar 17*a*. Additionally, a nozzle pipe 42 is mounted on the bar 17*a*. The cutter 19 is caused to move to the left or right on and along the bar 17*a* as a cutter driving motor 20 also mounted on the bar 17*a* (see FIG. 2) is driven in the forward or backward direction.

As can be best seen in FIG. 2, a pair of motors 21 and 22 are mounted on the inner side of one upstanding strut 15A. These motors 21 and 22 have respective output shafts which extend through the upstanding strut 15A and on which driving gears 21*a* and 22*a* are mounted at outer side of the upstanding strut 15A so as to mesh with intermediate gears 23 and 24, respectively. The intermediate gears 23 and 24 have respective gear shafts 23*a* and 24*a* supported between the upstanding struts 15A and 15B. The gear shaft 23*a* has sprockets 25A and 25B mounted at both ends, respectively. Similarly, a pair of sprockets 26A and 26B are fixedly mounted on the gear shaft 24*a* at both ends thereof, respectively.

Fixedly mounted on supporting shafts 16*b* of the empty roll supporting arms 16A and 16B are sprockets 27A and 27B which are operatively connected to the sprockets 25A and 25B by means of chains 28A and 28B, respectively, so that the empty roll supporting arms 16A and 16B are caused to rotate or swing clockwise or counterclockwise as the motor 21 is driven in the forward or backward direction. In the state where the transfer wagon 13 is located at the storage position shown in FIG. 1, the empty roll supporting arms 16A and 16B serve to support the empty roll 4A at a position above the cloth roll 4 which is disposed at the cloth wind-up position. In other words, the hands 16*a* assume the temporary empty-roll supporting position $P_2$ for temporarily supporting the empty roll.

Fixedly Mounted on a supporting shaft 17*b* for the cutter supporting arms 17A and 17B are sprockets 29A and 29B which are operatively coupled to the sprockets 26A and 26B through the medium of chains 30A and 30B, respectively, so that the cutter supporting arms 17A and 17B are caused to rotate in the clockwise or counterclockwise direction as the motor 22 is driven in the forward or backward direction. In the state in which the transfer wagon 13 is located at the storage position shown in FIG. 1, the cutter supporting arms 17A and 17B cooperate to support the cutter 19 at a position beneath the cloth roll 4 which is disposed at the cloth wind-up position $P_1$.

As shown in FIGS. 1 and 2, a gear 43 is mounted on the supporting shaft 16*b* of the empty roll supporting arm 16A so as to be rotatable relative to the upstanding strut 15A, while an electromagnetic clutch 44 is fixedly mounted on the upstanding strut 15A at a position adjacent to the gear 43. The electromagnetic clutch 44 has a clutch plate 44*a* which is forced to press against a side surface of the gear 43 when the electromagnetic clutch 44 is electrically energized, as a result of which the gear 43 is inhibited from rotation relative to the upstanding strut 15A.

Figure 6:
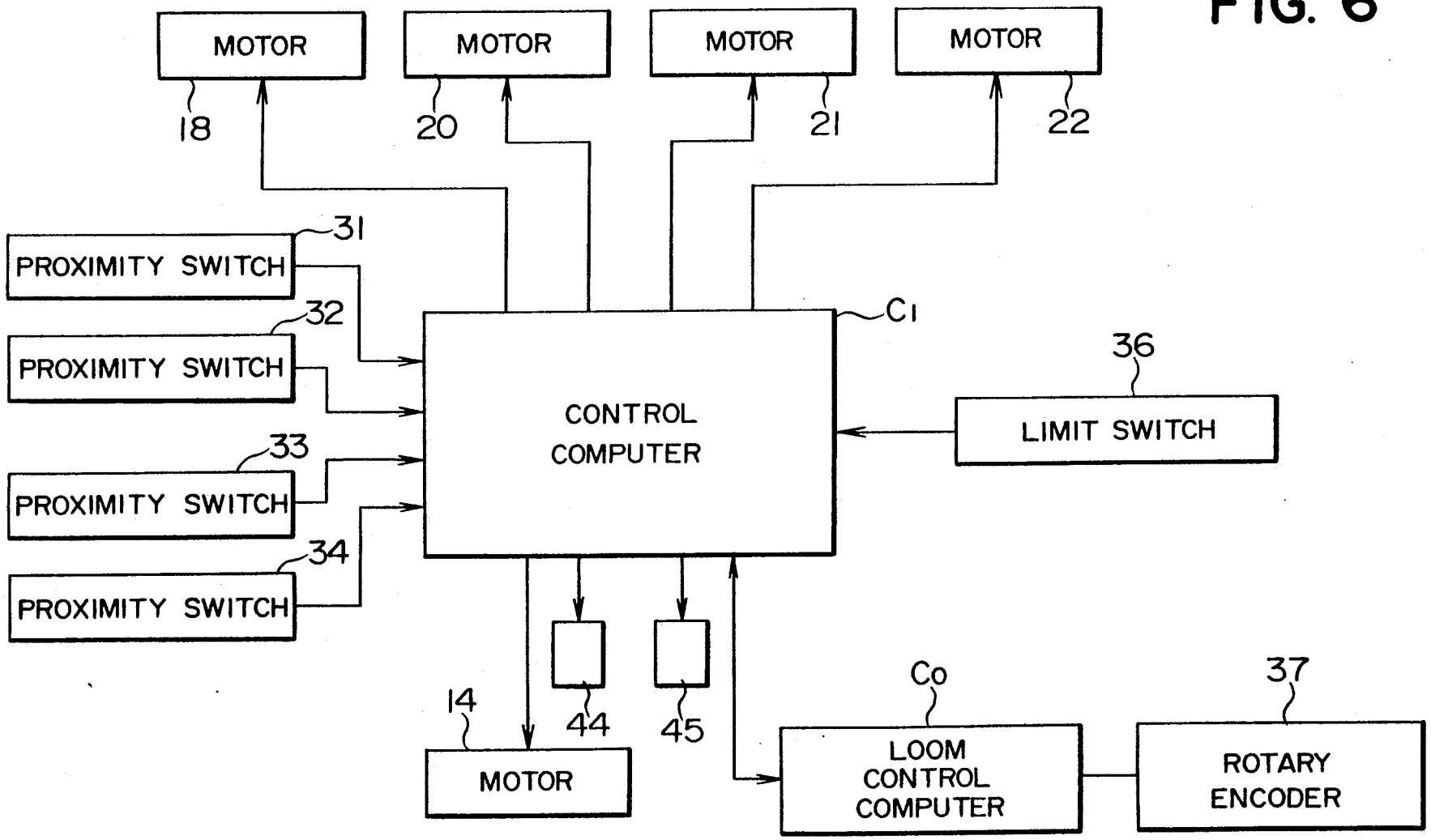
FIG. 6 is a block diagram showing a general arrangement of a controller for controlling operations of the cloth roll exchange apparatus.

Referring to FIG. 1, the transfer wagon 13 is provided with four proximity switches 31, 32, 33 and 34 which are adapted to be closed or turned on upon encountering an indexing mark member 35 provided on the weaving machine. As shown in FIG. 6, the output signals of the proximity switches 31 to 34 and that of the limit switch 36 are supplied to a control computer $C_1$ which serves for controlling the electric motors 14, 18, 20, 21 and 22, the electromagnetic clutch 44 and an electromagnetic valve 45 installed in the nozzle pipe 42 in response to the input signals supplied from a loom control computer $C_0$, the proximity switches 31 to 34 and the limit switch 36.

The loom control computer $C_0$ counts a reference pulse signal generated by a rotary encoder 37 upon every revolution of the loom, thereby detecting the number of rotations as well as angular position of the loom. When the count number has attained a predetermined value, the loom control computer $C_0$ outputs a cloth roll exchange signal to the control computer $C_1$. In response to the cloth roll exchange signal, the control computer $C_1$ issues a command signal for rotating the electric motor 14 in the forward direction, which results in that the transfer wagon 13 is caused to move to the most advanced position shown in FIG. 3 from the storage position (FIG. 1). During the movement of the transfer wagon 13 from the storage position to the most advanced position, the roll-out restraint release levers 39A and 39B are forced to abut on the cloth roll stoppers 10A and 10B, respectively, to thereby displace the cloth roll stoppers 10A and 10B from the roll-out restraining position shown in FIG. 1. Subsequently, kick-out levers 38A and 38B are caused to bear against the enlarged shaft portion **4*a* of the full cloth roll 4B disposed at the cloth wind-up position $P_1$, whereby the full cloth roll 4B is caused to roll out onto the paired rollers 41A and 41B mounted at the top ends of the upstanding struts 15A and 15B. In other words, the paired rolls 41A and 41B cooperate to define a temporary full-roll storage position $P_3$ (see FIG. 3). When the full cloth roll 4B is disposed at the temporary full-roll storage position $P_3$, the toothed wheel 4*c* of the full roll 4B is caused to mesh with the gear 43 while the limit switch 36** is closed.

Figure 3:
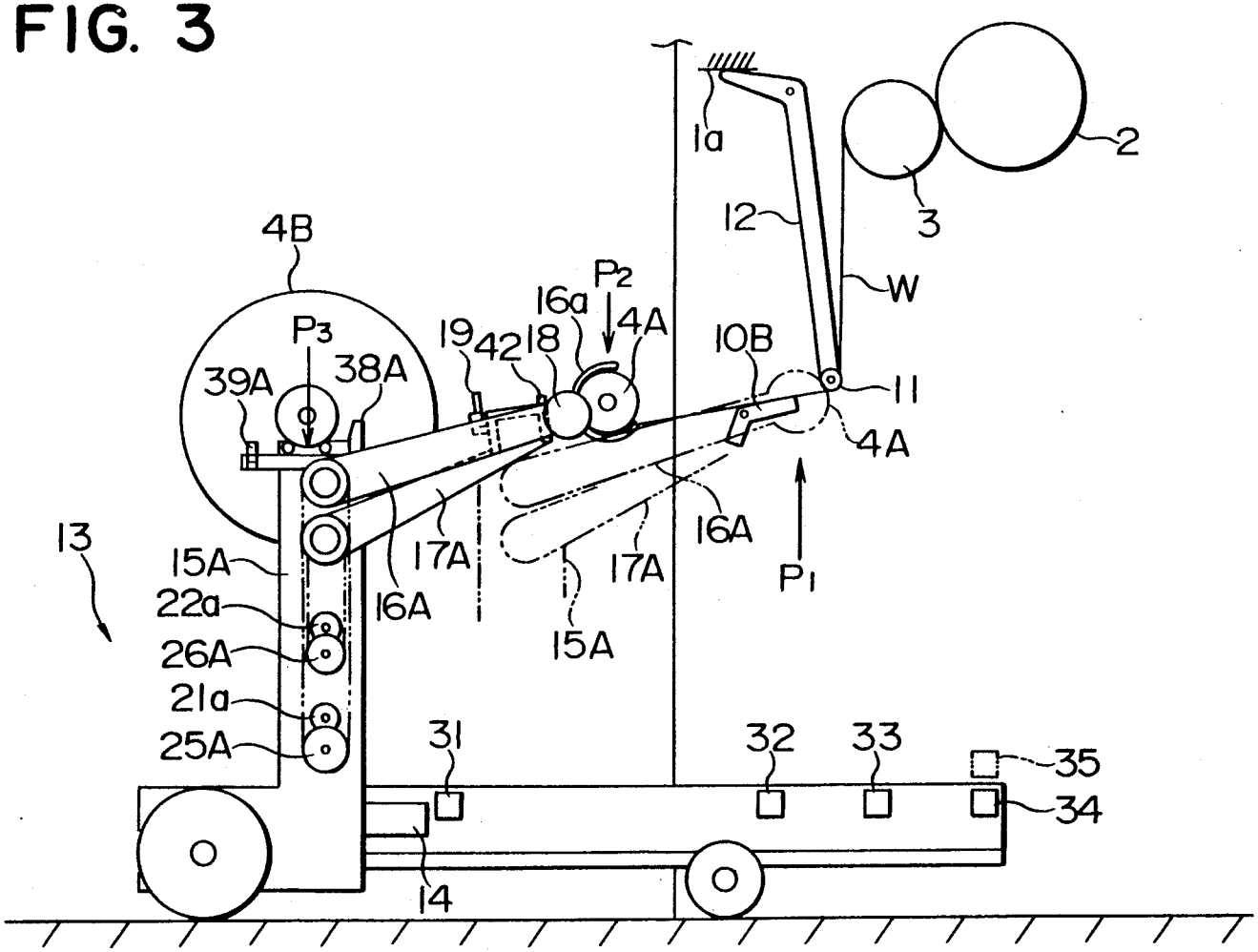
FIG. 3 is a side elevational view showing the cloth roll exchange apparatus in the state in which the transfer wagon is positioned at a most advanced position.
Figure 4:
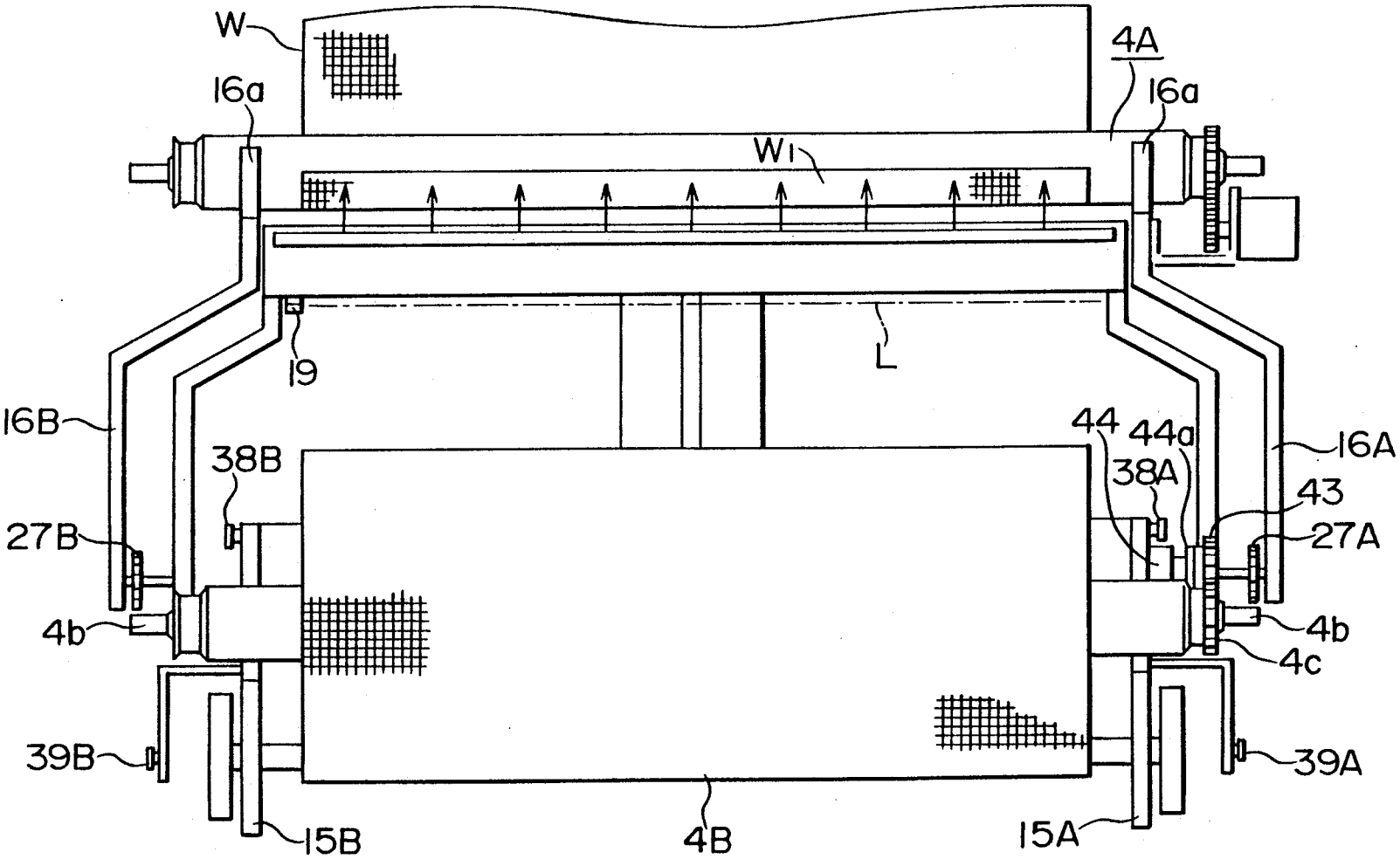
FIG. 4 is a top plan view showing the cloth roll exchange apparatus in the state for cutting a cloth.
Figure 5:
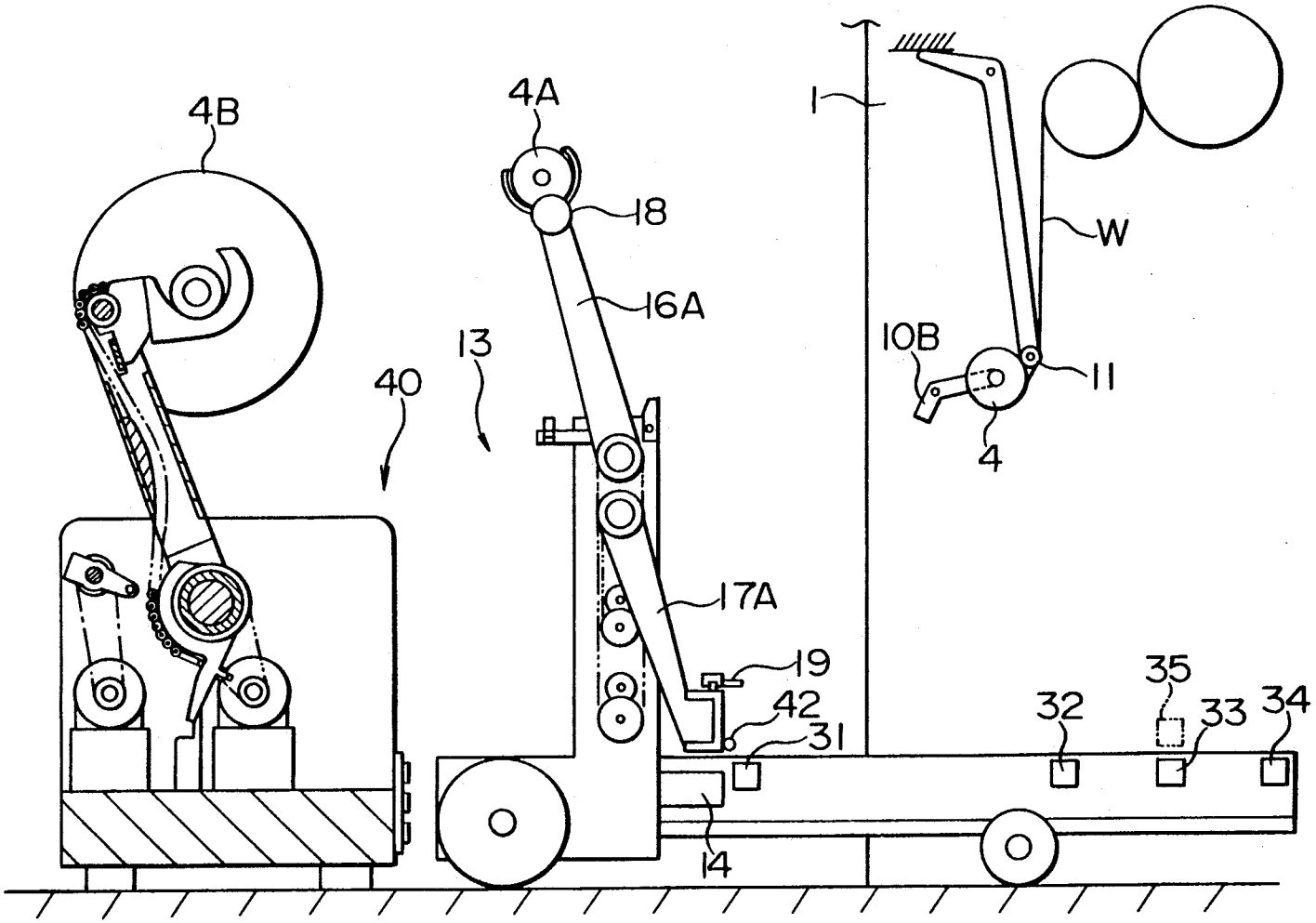
FIG. 5 is a side elevational view showing the transfer wagon at a cloth roll transfer position.

As the transfer wagon 13 having the full roll 4B disposed thereon moves toward the most advanced position shown in FIG. 3, the cloth W is drawn out from the full roll 4B, as the result of which the full roll 4B is caused to rotate on the paired supporting rollers 41A and 41B. The proximity switch 34 is closed upon encountering the indexing mark member 35 to generate an ON-signal. In response to this ON-signal, the control computer $C_1$ stops operation of the electric motor 14, whereupon the transfer wagon 13 is caused to stop at the most advanced position.

Upon stoppage of the transfer wagon 13, the control computer $C_1$ issues a turn-on command signal for the electromagnetic clutch 44 while commanding forward rotation of the electric motors 21 and 22 by a predetermined angular distance. On the other hand, upon energization of the electromagnetic clutch 44, the clutch plate **44*a* presses against the said surface of the gear wheel 43, resulting in that the gear 43 is inhibited from rotating relative to the upstanding strut 15A. As a consequence, the full cloth roll 4B is prevented from rotation at the temporary position $P_3$. In this manner, the electromagnetic clutch 44 and the gear 43** constitute the means for preventing rotation of the full roll.

On the other hand, when the motor 21 is driven in the forward direction, the empty roll supporting arms 16A and 16B are forced to move downwardly to the position shown in FIG. 3, whereby the empty roll 4A initially disposed at the temporary empty roll position $P_2$ is caused to move to the height corresponding to the cloth wind-up position $P_1$. In the meanwhile, the cutter supporting arms 17A and 17B are moved to the respective positions shown in FIG. 3 as the electric motor 22 is rotated forwardly until the cutter 19 is disposed at the substantially same height as the empty roll 4A. Consequently, the cloth W drawn out continuously from the full cloth roll 4B to the cloth wind-up position $P_1$ extends over the bar **17*a* and then beneath the empty roll 4A** in contact therewith.

In this respect, it should be mentioned that the weaving operation is continuously performed even during a period in which the transfer wagon 13 is displaced from the storage position, whereby the cloth W is continuously delivered to the empty roll 4A disposed on the hands **16*a* under the guidance of the cloth guide bar 11**.

After the forward rotation of the electric motors 21 and 22 for a predetermined angular distance, the control computer $C_1$ commands reverse (backward) rotation of the empty roll driving motor 18, as the result of which the empty roll 4A is caused to rotate in the backward direction on the hands **16*a*. Due to this backward or reverse rotation of the empty roll 4A, tension of the cloth between the full cloth roll 4B and the empty roll 4A increases to thereby stop the rotation of the torque motor 18 dedicated for rotating the empty roll 4A, when the above-mentioned tension has attained a predetermined value. In this state, tension of the cloth W extending between the full cloth roll 4B and the empty roll 4A** assumes a value which is suited for ensuring a satisfactory cutting of the cloth W.

After the reverse or backward rotation of the empty roll driving motor 18, the control computer $C_1$ issues a command for actuating the cutter driving motor 20 in the forward direction and at the same time commands electric energization of the electromagnetic valve 45. As the cutter driving motor 20 rotates in the forward direction, the cutter 19 moves in the direction from the cutter supporting arm 17A toward the cutter supporting arm 17B, whereby the cloth W extending over the bar **17*a* is progressively cut. At the same time, air jets are ejected from the nozzle pipe 42, as indicated by arrows in FIG. 4. As a consequence, a leading end portion $W_1$ of the cloth W resulting from the cutting operation is wound onto the peripheral surface of the empty roll 4A under the action of air jets ejected from the nozzle pipe 42. After the above movement of the cutter 19, the x control computer $C_1$ issues a command for reverse (backward) rotation of the cutter driving motor 20, resulting in that the cutter 19** restores the stand-by position.

In this respect, it should be noted that if the full cloth roll 4B is rotated in the cloth wind-up direction for imparting tension to the cloth W existing between the empty roll 4A and the full cloth roll 4B, the cloth existing between the empty roll 4A and the full cloth roll 4B will traverse a cutting path L of the cutter 19. As the cloth W traverses the cutting path L of the cutter 19, the former is obliquely cut by the cutter 19, resulting in that a number of wefts will be cut. This means that the cutting performance of the cutter 19 is thereby degraded within a short period, giving rise to a problem. Also, the oblique cutting exerts a considerable sliding or friction resistance to the side surface of the cutter blade 19, which is likely to involve irregular cut of the cloth to disadvantage.

To solve these problems, in the instant embodiment, the empty roll 4A is rotated in the state in which the rotation of the full cloth roll 4B is stopped. Consequently, the cloth W is pulled in the direction in which it is drawn out from the full cloth roll 4B. In other words, the cloth W spanning the space between the empty roll 4A and the full cloth roll 4B is cut in the stationary state relative to the cutting path L. Thus, the cloth W is positively prevented from being obliquely cut, whereby the smooth cutting of the cloth W can be ensured with the performance or property of the cutter 19 being protected against degradation.

After cutting of the cloth W, the control computer $C_1$ issues a command for forward rotation of the empty roll driving motor 18 and for reverse rotation of the motor 14, whereby a leading end portion $W_1$ of the cloth W remaining in the loom is taken up by the empty roll 4A owing to the forward rotation of the empty roll driving motor 18, while the transfer wagon 13 is retracted to the storage position owing to the reverse or backward rotation of the motor 14. Thus, the empty roll 4A is moved to the cloth wind-up position $P_1$ while taking up the leading end portion $W_1$ of the cut cloth W.

In the course of the backward movement of the transfer wagon 13, the proximity switch 32 passes by the indexing mark member 35, as a result of which the transfer wagon 24 stops at an empty roll placing or inserting position indicated by a phantom line in FIG. 3. Through this operation, the empty roll 4A supported by the hands **16*a*** is placed at the cloth wind-up position $P_1$.

After having positioned the empty roll in place, the transfer wagon 13 is advanced forwardly, whereby the proximity switch 33 again passes by the indexing mark member 35. As a result of this, the transfer wagon 13 stops at the cloth roll transfer position shown in FIG. 5 and waits for arrival of a transporting bogie 40. An empty roll 4A carried by the transporting bogie 40 is then transferred onto the hands **16*a* with the full cloth roll 4B being transferred to the transporting bogie 40. Upon removal of the full cloth roll from the transfer wagon 13, the limit switch 36 is opened to allow the transfer wagon 13 to be retracted to the storage position shown in FIG. 1**.

As described hereinbefore in the preamble of the specification, in the application where a small number of transporting bogies are used for servicing a large number of looms for the cloth roll exchange, a lot of time will sometimes be taken for the transporting bogie to arrive at a loom of concern in response to a call signal. In case the cloth roll exchange apparatus is installed on the transporting bogie, as is disclosed in JP-A-60-171956, the cloth roll exchange can not be performed until the transporting bogie has arrived at the loom which issued the call signal. As a consequence, the loom operation must be stopped if the transporting bogie has to be awaited for a long time, as a result of which the availability or operation efficiency of the loom is lowered.

However, with the cloth roll exchange apparatus of the illustrated embodiment, the exchange of the full cloth roll 4B with the empty roll 4A is performed between the loom and the transfer wagon 13 regardless of the presence or absence of the transporting bogie 40, whereby the full cloth roll 4B is temporarily stored on the transfer wagon 13 until arrival of the transporting bogie 40. Thus, by appropriately setting the position for receiving the full cloth roll 4B on the transfer wagon 13 so that the full cloth roll 4B carried by the transfer wagon 13 which is located at the transfer position is properly distanced from the cloth roll 4 at the cloth wind-up position $P_1$, the weaving operation of the loom can be continuously carried out while avoiding the interference between the full cloth roll 4B disposed at the temporary full-roll position $P_3$ and the cloth roll 4 at the cloth wind-up position $P_1$. In other words, the cloth roll exchange can be performed without need for stopping the loom operation even when the arrival of the transporting bogie 40 is delayed.

The arrangement of the cloth roll exchange apparatus on the transfer wagon 13 according to the teachings of the invention is also applicable even in the case where the use of the transporting bogie is inhibited. To this end, it is sufficient to set the roll transfer position on the transfer wagon 13 so that the full cloth roll 4B at the temporary full-roll position $P_3$ does not interfere with the cloth roll 4 disposed at the cloth wind-up position $P_1$. In case the cloth roll 4 at the cloth wind-up position $P_1$ should become full before the arrival of the transporting bogie, the weaving operation of the loom is then stopped through operation of the limit switch 36 which is destined to detect presence or absence of the full cloth roll 4B on the transfer wagon 13. At the same time, proper measures may be taken for disabling the cloth roll exchange.

The embodiment of the invention described above is susceptible to diverse modifications. By way of example, instead of rotating the empty roll 4A supported by the hands **16*a* in order to apply tension to the cloth W, it is possible to obtain the same effect by rotating the full cloth roll 4B disposed at the temporary position $P_3$ in the cloth wind-up direction by driving correspondingly the torque motor. In that case, the possibility of the cloth being cut obliquely can be avoided by preventing the cloth which is in contact with the peripheral surface of the empty roll 4A from moving slidingly on and along the peripheral surface of the empty roll 4A. It is also conceivable to provide a shoe for restraining the rotation of the full cloth roll by pressing the shoe against the roll shaft. Although the advancing operation of the transfer wagon 13 is made use of for moving the full cloth roll 4B from the cloth wind-up position $P_1$ to the predetermined position on the transfer wagon 13, it is conceivable to install a full roll discharge/dispensing mechanism in the loom for displacing the full cloth roll 4B from the cloth wind-up position $P_1$ onto the transfer wagon 13 while dislodging the cloth roll stoppers 10A and 10B** from the respective roll-out preventing positions.

Figure 7:
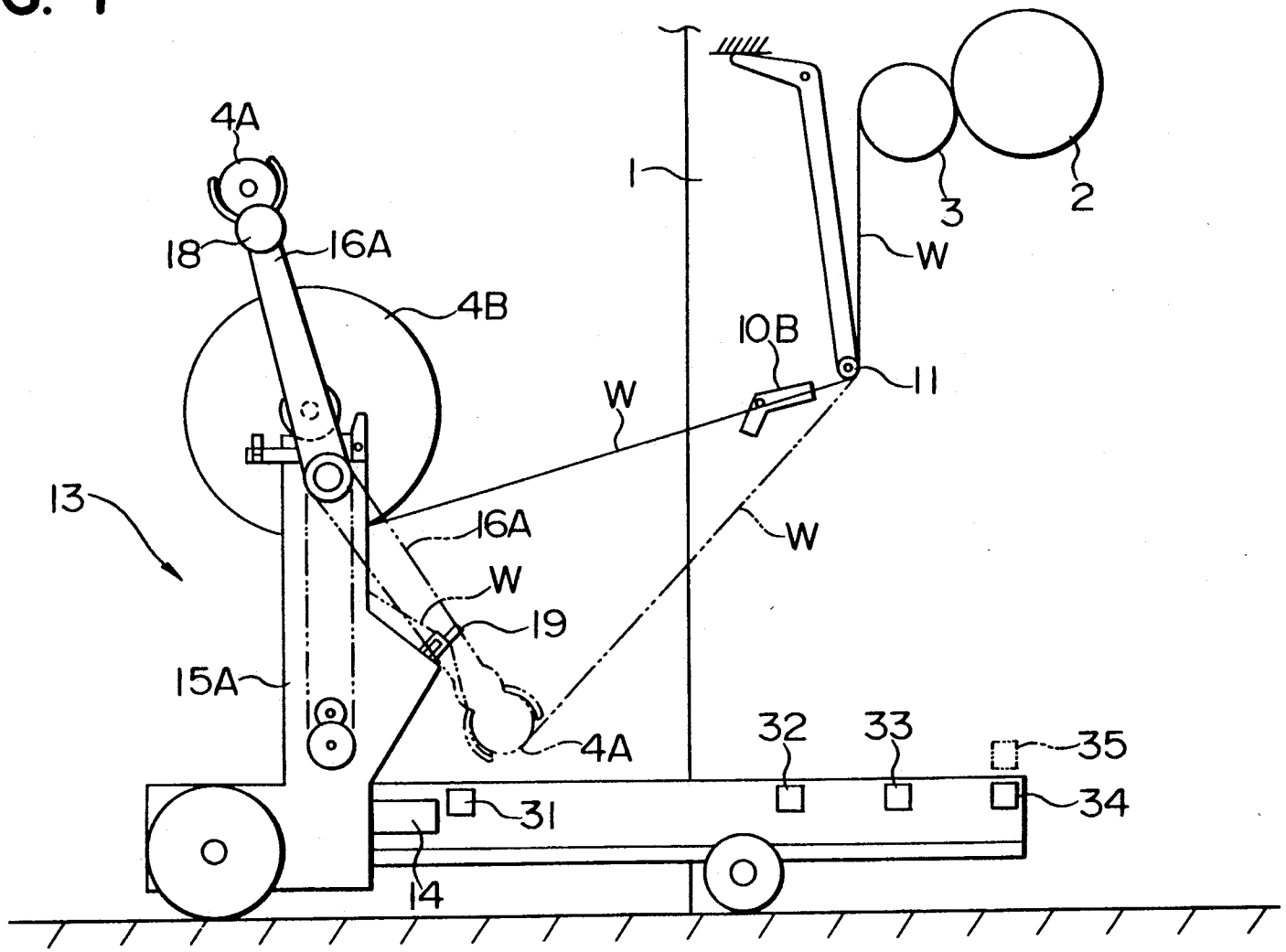
FIG. 7 is a side elevational view of a cloth roll exchange apparatus according to another embodiment of the invention.

FIG. 7 shows a cloth roll exchange apparatus according to another embodiment of the invention, which differs from the apparatus described above in that the cutting path of the cutter mechanism 19 installed on the transfer wagon 13 is set fixedly. For cutting the cloth W, the empty roll supporting arms 16A are moved downwardly to a position indicated by a broken line to thereby align the path of the cloth W extending from the full cloth roll 4B with the above-mentioned cutting path.

Next, yet another embodiment of the invention will be described with emphasis put on the operation thereof. In the instant embodiment now under consideration, such arrangement is adopted that the presence of the full cloth roll at the temporary storage position on the transfer wagon is detected by a proximity switch which cooperates with a toothed wheel provided in the enlarged shaft portion of the cloth roll with a view to effectuating the detection of the presence or absence of the full cloth roll in the cloth roll exchange apparatus as well as the detection of tension applied to the cloth. The full cloth roll is rotated in the cloth wind-up direction by the full roll driving motor, during which the cloth imparted with a tension due to the roll rotation mentioned above is cut by the cutter moved in the direction widthwise of the cloth. The tension as applied to the cloth is also detected by the proximity switch in cooperation with the aforementioned toothed wheel. On the other hand, presence of an empty roll at the cloth take-up position is detected by another proximity switch. The empty roll is rotated in the cloth take-up direction by the empty roll driving motor, whereby the trailing portion of the cloth resulting from the cutting is taken up by the empty roll. Completion of this operation phase is detected by said another proximity switch in cooperation with the toothed wheel.

Figure 8:
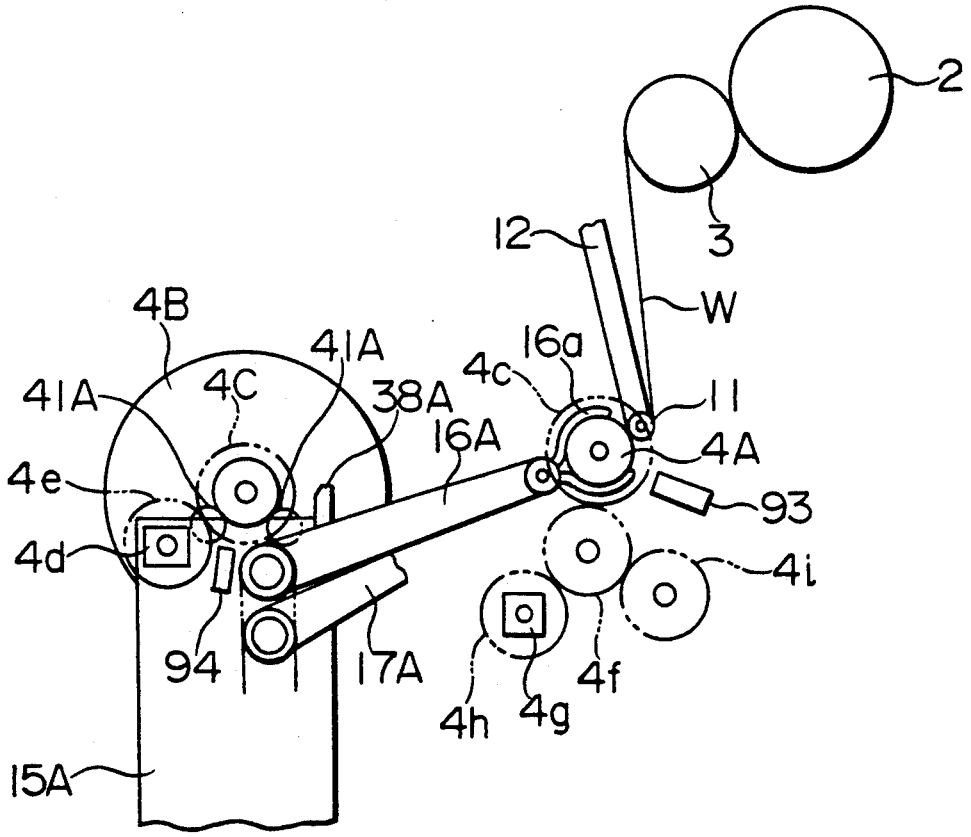
FIG. 8 is a fragmentary side elevational view showing a major portion of a cloth roll exchange apparatus according to still another embodiment of the present invention.

In conjunction with the embodiment now under consideration, description will first be made of those parts or members which are not employed in the cloth roll exchange apparatuses shown in FIGS. 1 to 7. As can be seen in FIG. 8, a toothed wheel or disk 4c is mounted on the cloth roll shaft. In the state in which the full cloth roll 4B is disposed at the position on the upstanding strut 15A and 15B (only the strut 15A is shown) of the transfer wagon through the medium of the interposed supporting rollers 41A, the toothed wheel 4c meshes with a driving gear 4e driven by the full roll rotating motor 4d. On the other hand, when the empty roll 4A is disposed at the position shown in FIG. 8, the toothed wheel 4c meshes with an intermediate gear 4f to be thereby coupled to an empty roll driving gear 4h driven by a motor 4g for rotating the empty roll disposed at the wind-up position by way of the intermediate gear 4f and a cloth roll driving gear 4i which is coupled to the loom through a clutch (not shown). Further, proximity switches 93 and 94 are mounted in the vicinity of the toothed wheel 4c of the empty roll 4A disposed at the cloth wind-up position and the toothed wheel 4c of the roll shaft of the full cloth roll 4B disposed at the temporary position on the supporting rollers 41A, respectively. The toothed wheels 4c are adapted to mesh with the intermediate gear 4f.

Next, description will turn to operation of the members which play an important role in the roll exchange apparatus shown in FIG. 8.

The proximity switch 93 detects only the tooth tips of the toothed wheel 4c of the cloth roll shaft disposed at the cloth wind-up position to output a pulse signal having a frequency corresponding to the rotational speed of the toothed wheel 4c. On the other hand, the proximity switch 94 detects only the tooth tips of the toothed wheel 4c of the cloth roll shaft disposed at the temporary position to thereby output a pulse signal having a frequency corresponding to the rotational speed of the associated toothed wheel 4c. The pulse signals generated by the proximity switches 93 and 94 are supplied to the control computer $C_1$ (refer to FIG. 6) which responds to these input signals from the proximity switches 93 and 94 to control actuation of the empty roll driving motor 4g and the full cloth roll driving motor 4d.

When the full cloth roll 4B has arrived at the temporary storage position, the proximity switch 94 cooperates with the toothed wheel 4c to generate the pulse signal having a frequency corresponding to the rotational speed of the full cloth roll 4B. If there should arise such situation that the full cloth roll 4B could not arrive at the temporary storage position, the control computer $C_1$ supplies a weaving operation stop signal to the loom control computer $C_0$ (FIG. 6) and at the same time stops operation of the full roll driving motor 4d.

Upon reception of the pulse signal from the proximity switch 94, the control computer $C_1$ stops the reverse rotation of the full roll driving motor 4d and at the same time operates the proximity switch 93 for actuating the empty roll driving motor 4g. In this manner, so long as the presence of the full cloth roll 4B at the temporary storage position is not detected, neither the stoppage of the reverse rotation of the full roll driving motor 4d nor the actuation of the empty roll driving motor 4g is triggered. The presence of the full cloth roll 4B at the temporary storage position is detected by the proximity switch 94 through cooperation with the toothed wheel 4c.

When the empty roll 4A is mounted at the cloth wind-up position, the empty roll 4A is rotated in the cloth take-up direction by the empty roll driving motor 4g, and the proximity switch 93 generates the pulse signal having a frequency corresponding to the rotational speed of the empty roll 4A. The control computer $C_1$ responds to the pulse signal to trigger the forward rotation of the full cloth roll driving motor 4d. To say in another way, the full roll driving motor 4d can never be actuated in the forward direction so long as the empty roll 4A is absent at the cloth wind-up position.

The proximity switch 94 generates the pulse signal having a frequency corresponding to the rotational speed of the full cloth roll 4B driven by the full roll driving motor 4d rotating in the forward direction. When the frequency of the pulse signal falls below a preset frequency, the cutter driving motor provided in association with the cutter supporting arm 17A is actuated in the forward direction, whereupon the cutter (refer to FIG. 2) starts to run from the left-hand side frame toward the right-hand side frame, as viewed in the figure.

The preset frequency mentioned above serves as a reference for detecting the tension of the cloth spanning the empty roll 4A and the full cloth roll 4B. To this end, this pulse frequency is so selected as to correspond to the rotation number of the full roll driving torque motor at the time point when the tension of the cloth has attained a level suited for cutting the cloth. As the tension applied to the cloth increases, the rotational speed of the full roll driving motor 4d becomes lower. Accordingly, when the pulse frequency falls below the preset value mentioned above, this means that the tension of the cloth is at the level suited for severing the cloth by the cutter. Thus, smooth cutting of the cloth by the cutter can be ensured.

In this conjunction, when the full cloth roll 4B is brought to the temporary storage position on the transfer wagon, the driving motor 4d is rotated in the direction reverse to the cloth winding direction. In that case, the full cloth roll 4B disposed at the temporary storage position continues to rotate in the direction reverse to the cloth winding direction until the full roll driving motor 4d is stopped. As a result, the cloth extending from the full cloth roll 4B becomes slackened. In this respect, it should also be mentioned that even when the full cloth roll driving motor 4d is not operated in the reverse direction, the cloth portion extending from the full cloth roll 4B assumes the slackened state, because the cloth is continuously fed to the full cloth roll 4B under the drawing action exerted through cooperation of the surface roller 2 and the press roller 3 so long as the loom operation is continued. In the slackened state of the cloth, cutting thereof by the cutter is impossible.

However, such slack of the cloth is removed by rotating the full cloth roll driving motor 4d in the forward direction, while an appropriate tension is applied to the cloth. Thus, the cloth cutting operation of the cloth roll exchange apparatus installed at the side of the loom can be performed while continuing the loom operation, whereby the loom operation efficiency can be enhanced when compared with the apparatus known heretofore.

The forward rotation of the full cloth roll driving motor 4d for imparting tension to the cloth extending from the full cloth roll 4B disposed at the temporary storage position is not effectuated so long as presence of the empty roll 4A at the cloth wind-up position is not detected. In other words, the presence of the empty roll 4A at the cloth wind-up position is the prerequisite for application of the tension, wherein the presence of the empty roll at the cloth wind-up position is detected through cooperation of the proximity switch 93 and the toothed wheel 4c.

At this juncture, it is to be noted that the forward operation of the cutter driving motor is performed after the forward actuation of the full roll driving motor 4d. In other words, the forward rotation of the cutter driving motor is not performed so long as the tension imparted to the cloth by the forward rotation of the full roll driving motor 4d does not attain the proper level, during which the cutter continues to remain at the stand-by position. In this manner, the properly tensioned cloth state brought about by the forward rotation of the full roll driving motor 4d constitutes the prerequisite condition for allowing the cutting operation of the cutter means. The properly tensioned state of the cloth is detected by the proximity switch 94 arranged to detect a series of teeth formed in the toothed wheel 4c.

As can be understood from the above description, by providing a groove/projection repetition row such as a series of teeth of the toothed wheel 4c as the object for detection of the proximity switch 94, both detection of presence or absence of a full cloth roll 4B at the temporary storage position and detection of the cloth tension can be realized by using only one proximity switch 94, whereby limitation imposed to freedom in design of a complicated mechanism such as the cloth roll exchange apparatus can be mitigated.

When the number of detection pulses outputted from the proximity switch 94 has attained a predetermined number after the start of forward rotation of the full roll driving motor 4d, operation of the motor 4d and proximity switch 94 are disabled. By continuing rotation of the full cloth roll 4B until the detection pulse number has attained the predetermined value, the trailing cloth portion resulting from the cutting operation is taken up around the full cloth roll 4B, whereby the full cloth roll 4B which has no trailing end portion can be obtained as a finished product, which then waits for the arrival of the cloth roll transporting bogie.

On the other hand, the empty roll 4A at the cloth wind-up position is rotated in the cloth wind-up direction by the empty roll driving motor 4g, whereby the leading end portion resulting from the cutting operation is taken up by the empty roll 4A.

As the empty roll 4A is rotated by the empty roll driving motor 4g, the proximity switch 93 outputs a pulse signal having a pulse frequency corresponding to the rotational speed of the empty roll 4A. When the frequency of this pulse signal falls below a preset value, operation of the empty roll driving motor 4g is stopped. When the pulse frequency has attained the preset value, the tension applied to the cloth being taken up increases to a value preset by a torque limiter (not shown). Due to the increase in the tension, torque of the empty roll 4A also increases, eventually resulting in that the empty roll driving motor 4g stops rotation. Subsequently, further rotation of the empty roll 4A is ensured by the loom driving motor.

Once the driving of the empty roll 4A has been changed over to the driving by the loom driving motor through the cloth roll driving gear, operation of the empty roll driving motor 4g is no more required. Stoppage of operation of this motor 4g is effectuated when the leading end portion of the cloth resulting from the cutting operation has been completely taken up by the empty roll 4A. At that time, the rotational speed of the empty roll 4A is lowered to the weaving rotation speed, which in turn means that the tension applied to the cloth assumes a value which is set for the weaving operation. This change in the tension applied to the cloth is detected by the proximity switch 93 which cooperates with the toothed wheel 4c.

As will be understood from the above description, by providing a groove/projection repetition row such as a series of teeth of the toothed wheel 4c as the object for detection of the proximity switch 94, both detection of presence or absence of the empty roll 4A at the cloth wind-up position and detection of the cloth tension can be realized by the single proximity switch 93, whereby limitation imposed to freedom in design of a complicated mechanism such as the cloth roll exchange apparatus can be mitigated The toothed wheel 4c or gear is inherently provided for the purpose of realizing the operative coupling with the loom driving motor. While it has been described that the gear 4c is also utilized as the object for detection or detection area for the proximity switch 93 and 94, it will readily be appreciated that the groove/projection repetition row defining the area for detection by the proximity switches 93 and 94 may be implemented in any other appropriate form than the toothed wheel 4c.

In the case of the embodiment described above, the proximity switches are provided in association with both of the temporary storage position and the wind-up position, respectively. However, such modification may also be adopted in which only one proximity switch is provided in the vicinity of the wind-up position by mounting that switch on the empty roll supporting arm.

Figure 9:
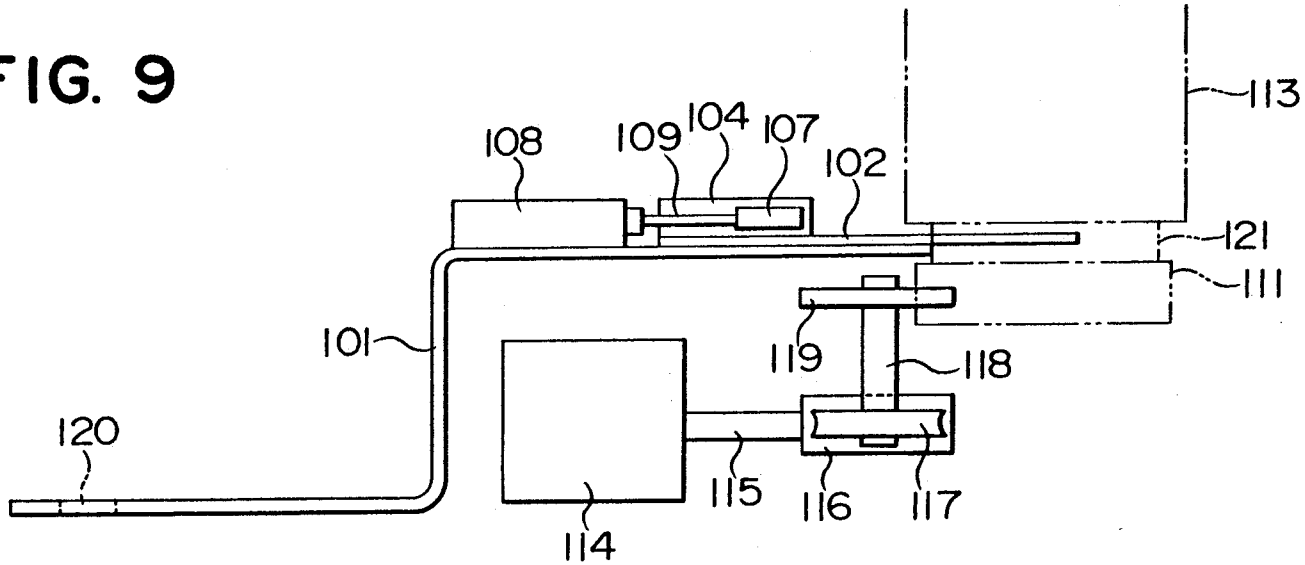
FIG. 9 is a fragmentary front view of a cloth roll exchange apparatus according to a modified embodiment of the present invention in which detection of a cloth roll as well as detection of tension applied to a cloth is realized by means of a proximity switch provided in association with an empty roll holding means of a type adapted to be mounted on the transfer wagon.
Figure 10:
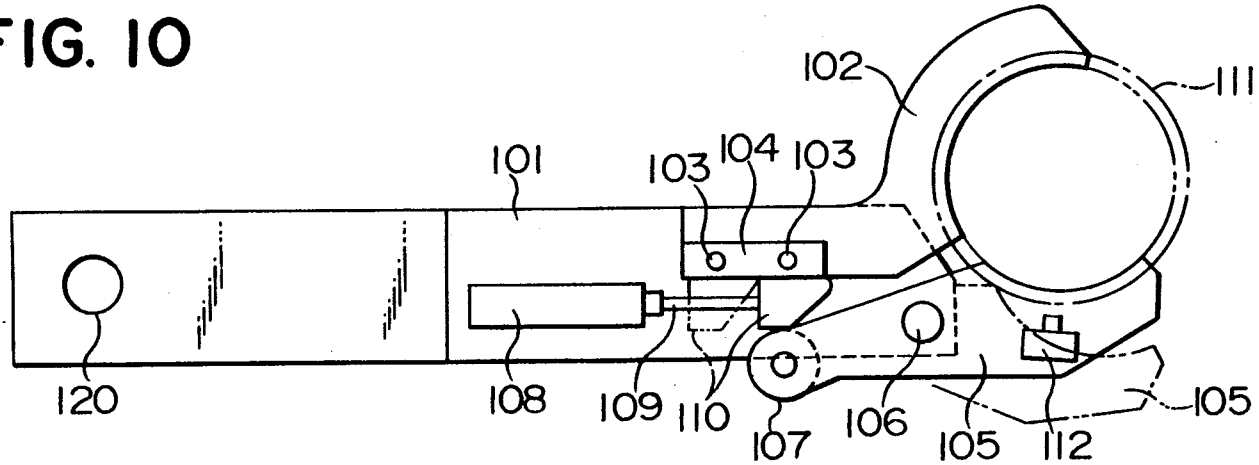
FIG. 10 is a side elevational view showing a structure of the empty roll holding means in the apparatus shown in FIG. 9.

This modification will be described below by reference to FIGS. 9 and 10 which show the empty roll supporting arm and the relevant members disposed in the vicinity thereof. The empty roll supporting arm 101 mounted on the transfer wagon (not shown) at a hole 120 has a fixed gripper 102 secured fixedly to the arm body by means of bolts 103 and a movable gripper 105 which is supported by a pin 106 rotatably relative toward the arm body and normally urged to rotate in the clockwise direction to an empty roll release position indicated by a broken line under the influence of a coil spring (not shown). When the movable gripper 105 is rotated to an empty roll grip position indicated by a solid line by a mechanism described below, the cloth roll or empty roll 113 is gripped between the fixed gripper 102 and the movable gripper 105 which engage in a retaining groove 121.

An actuator such as a cylinder 108 is provided in association with the empty roll supporting arm 101. Upon actuation of the cylinder 108, a release cam 110 provided on a piston rod 109 of the cylinder 108 is moved from a position indicated by a broken line to a position indicated by a solid line under the guidance of a guide member 104, as a result of which the movable gripper 105 is caused to rotate counterclockwise toward the empty roll grip position against the effort of the coil spring mentioned above by way of a cam follower 107 mounted on the movable gripper 105 so as to be positioned on the path along which the release cam 110 is moved, whereby the empty roll is held by the movable gripper 105 in cooperation with the fixed gripper 102.

The empty roll 113 is driven by an empty roll driving motor 114 through a transmission path including a motor output shaft 115, a worm 116, a worm wheel 117, a shaft 118, a driving gear 119 and a toothed wheel 111 (formed in the shaft of the empty roll 113). Thus, the empty roll 113 is rotated in a cloth wind-back direction by rotating forwardly the motor 114.

A proximity switch 112 such as a magnetic sensor is provided at a position in opposition to teeth (not shown) of the toothed wheel or gear 111. The proximity switch 112 serves for detecting the rotational speed of the empty roll 113 by detecting grooves and projections defined by the teeth of the toothed wheel. Thus, the tensioned state of the cloth can be detected on the basis of the inter-pulse interval of a detection pulse signal generated by the proximity switch 112.

In the deenergized state of the motor 114, the empty roll 113 is held in the stationary state due to interlock effective between the worm 116 and the worm wheel 117 which meshes with the worm 116. In the case of the modified apparatus described above, the cloth cutting as well as taking-up of trailing and leading portions of the cloth is performed between the position of the doffed full roll and the cloth wind-up position.

It is thought that the present invention and many of its attendant advantages will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

We claim:

1. A cloth roll exchange apparatus for a weaving machine, comprising:

a transfer carriage adapted to be provided in the weaving machine for selective movement between a storage position within the weaving machine and a cloth roll transfer position in front of the weaving machine;

means for selectively moving said transfer carriage between said positions;

a temporary full-roll hold means installed on said transfer carriage;

temporary empty-roll hold means installed on said transfer carriage;

a full roll discharge mechanism for discharging and transferring a full roll having a cloth roll shaft from a cloth wind-up position on said weaving machine to said temporary full-roll hold means;

an empty roll inserting mechanism installed on said transfer carriage for moving and inserting an empty roll including a cloth roll shaft from said temporary empty-roll hold means to said cloth wind-up position; and cloth cutting means installed on said transfer carriage for cutting the cloth successively extending from the full cloth roll disposed at said temporary full-roll hold means to said weaving machine.

2. A cloth roll exchange apparatus according to claim 1, wherein said transfer carriage includes a pair of laterally spaced upstanding struts disposed in opposition to each other, each of said upstanding struts having a top end formed with a temporary full-roll receiving recess which constitutes a part of said temporary full-roll hold means.

3. A cloth roll exchange apparatus according to claim 2, wherein a pair of supporting rollers are mounted adjacent to each of said recesses so that said cloth roll shaft is rotatably disposed on said supporting rollers.

4. A cloth roll exchange apparatus according to claim 2, wherein said full roll discharge mechanism includes a kick-out lever mounted at the top end of said upstanding strut.

5. A cloth roll exchange apparatus according to claim 2, wherein said empty roll inserting mechanism includes empty roll supporting arms each mounted rotatably on each of said upstanding struts, and hands mounted on each of said empty roll supporting arms at a free end thereof to receive the empty roll therein in a releasable manner.

6. A cloth roll exchange apparatus according to claim 5, wherein said empty roll inserting mechanism further includes an empty roll driving motor constituted by a torque motor and mounted on one of said empty roll supporting arms.

7. A cloth roll exchange apparatus according to claim 2, wherein said cloth cutting means includes:

means for preventing rotation of the full roll transferred to said temporary full-roll hold means from said cloth wind-up position;

means for holding the empty roll so that said empty roll is brought into contact with the cloth extending continuously from the full roll disposed at said temporary full-roll hold means to said weaving machine;

means for rotating the empty roll held by said empty roll holding means; and means for cutting the cloth existing between the full roll disposed at said temporary full-roll hold means and the empty roll brought into contact with the cloth along a cutting path extending in the direction widthwise of said cloth;

whereby said cloth is cut while under tension created by rotating said empty roll while said full roll is prevented from rotation.

8. A cloth roll exchange apparatus according to claim 7, wherein said empty roll holding means includes empty roll supporting arms each mounted rotatably on each of said upstanding struts, and hands mounted on said empty roll supporting arms at respective free ends for releasably gripping said empty roll.

9. A cloth roll exchange apparatus according to claim 7, wherein said rotation preventing means includes a gear supported rotatably on and relative to a supporting shaft of said empty roll supporting arm, and an electromagnetic clutch mounted on said upstanding strut adjacent to said gear, said electromagnetic clutch has a clutch plate which is pressed against a side surface of said gear upon electric energization of said electromagnetic clutch to thereby inhibit said gear from rotating relative to said upstanding strut.

10. A cloth roll exchange apparatus according to claim 7, including means for constraining said cloth cutting means to follow a cutting path that is fixed relative to said transfer carriage.

11. A cloth roll exchange apparatus according to claim 1, wherein a groove/projection repetition row is provided circumferentially on said cloth roll shaft, further comprising:

proximity switch means disposed in the vicinity of the cloth roll supporting position;

an area subjected to detection by said proximity switch means, said area being defined on the groove/projection repetition row of the cloth roll shaft supported at said cloth roll supporting position; and cloth roll rotating means for rotating the cloth roll shaft at said cloth roll supporting position.

12. A cloth roll exchange apparatus according to claim 11, wherein said cloth roll supporting position is provided above said temporary full-roll hold means.

13. A cloth roll exchange apparatus according to claim 12, wherein said groove/projection repetition row comprises a toothed wheel provided on said cloth roll shaft.

14. A cloth roll exchange apparatus according to claim 13, wherein presence of said full roll at said temporary full-roll hold means is detected by said proximity switch means which cooperates with said toothed wheel provided on said cloth roll shaft, and wherein said full roll is rotated in the cloth wind-up direction by said cloth roll rotating means constituted by a full roll driving motor so as to allow the cloth to be cut by said cloth cutting means while tensioned by rotation of said full roll.

15. A cloth roll exchange apparatus according to claim 11, wherein said cloth roll supporting position defines a cloth wind-up position, said groove/projection repetition row is realized in the form of a toothed wheel provided on said cloth roll shaft, the presence of the empty roll at said cloth wind-up position is detected by another proximity switch means in cooperation with said toothed wheel, and wherein said empty roll is rotated in the cloth wind-up direction by means of said cloth roll driving means constituted by an empty roll driving motor to take up a leading end portion of the cloth which results from the cutting of said cloth.

16. A cloth roll exchange apparatus according to claim 15, wherein said another proximity switch for detecting the presence of the empty roll at said cloth wind-up position is mounted on an empty roll supporting arm constituting a part of said empty roll inserting mechanism.

17. A cloth cutting method for a cloth roll exchange apparatus for a weaving machine, comprising the steps of:

moving a full cloth roll from a cloth wind-up position on said weaving machine to a temporary full-roll hold position;

thereafter superimposing on the cutting path of a cutter the path of cloth existing between said full cloth roll and an empty roll where said empty roll is held at a position other than said cloth wind-up position, and where said cutting path of said cutter extends in a direction widthwise of said cloth; and cutting said cloth along said cutting path while wind-up of said cloth is interrupted and said cloth is maintained under tension.

* * * * *